United States Patent [19]

Howard et al.

[11] 4,171,060

[45] Oct. 16, 1979

[54] COVERED DRINKING CUP

[75] Inventors: James S. Howard, Corona; Joseph F. Ortiz, San Diego, both of Calif.

[73] Assignee: Spil-Les, Oceanside, Calif.

[21] Appl. No.: 968,464

[22] Filed: Dec. 11, 1978

[51] Int. Cl.[2] ..... A47G 19/22

[52] U.S. Cl. ..... 220/254; 220/90.4; 222/506; 222/518

[58] Field of Search ..... 220/90.2, 90.4, 90.6, 220/254, 259, 336, 231, 262, 263, 264, 346, 347, 348, 367; 222/557, 142.9, 549, 550, 520, 512, 518, 506, 509

[56] References Cited

U.S. PATENT DOCUMENTS

| | | | |
|---|---|---|---|
| 2,067,298 | 1/1937 | Watson | 222/509 X |
| 2,183,912 | 12/1939 | Isler | 222/506 X |
| 3,153,498 | 10/1964 | Bakker | 222/506 |
| 3,967,748 | 7/1976 | Albert | 220/90.4 |
| 4,133,446 | 1/1979 | Albert | 222/518 X |
| 4,136,799 | 1/1979 | Albert | 220/90.4 X |

FOREIGN PATENT DOCUMENTS

| | | | |
|---|---|---|---|
| 1191709 | 4/1959 | France | 220/520 |

*Primary Examiner*—Joseph Man-Fu Moy
*Attorney, Agent, or Firm*—Henri J. A. Charmasson

[57] ABSTRACT

A thermo-insulated drinking cup covered by a detachable lid; the lid having a depressed top area and an orifice. A valve closing said orifice is actuated by a rotating thumb-controlled lever. The lever is effective when rotated in either direction in order to accommodate right-handed or left-handed handling of the cup.

5 Claims, 14 Drawing Figures

COVERED DRINKING CUP

BACKGROUND OF THE INVENTION

Conventional coffee mugs tend to dissipate heat rapidly, and the slow drinker ends up swallowing a large amount of lukewarm or cold beverage. The problem has been somewhat palliated by the introduction of plastic thermo-insulated cups. But since most of the heat is dissipated through the top opening of the vessel, the insulation of the walls and bottom is only partially effective.

People such as drivers, fishermen, railroad engineers, heavy equipment and crane operators, who like to sip hot or cold beverages in a moving vehicle find conventional drinking cups awkward to use in such situations, and subject to spillage.

People working in a dusty environment such as on construction sites, textile mills, steel mills, etc., who like to drink hot or cold beverages at work, need a drinking cup which will protect its contents from the ambient dust.

Cups, mugs or tumblers with removable covers have been provided in the past, but they are often impractical, awkward to use and unsightly.

Tumblers, partially covered on top, have been available as training cups for infants. They are very awkward to use, and do not resolve the problem of spilling when such a cup is knocked over by a clumsy child.

There is also a need for a dispenser for spices, sugar, flour or other cooking ingredients, which can be held and opened single handedly while the other hand is busy stirring or performing other cooking chores.

SUMMARY OF THE INVENTION

One object of the present invention is to provide a drinking vessel having:

a top cover for heat conservation, and a drinking or pouring orifice which can be easily opened or closed;

A sunken area in the top cover to provide room for the nose of the user;

a handle combined with a thumb-operated, spring-biased stopper to control the flow of liquid through said orifice;

a stopper which automatically closes said orifice when the vessel is not in use, and which can be easily disassembled for cleaning purposes;

A further object of the present invention is to provide a covered, handled container for liquid and powdered substances which can be held, operated and shut single handedly by either a right-handed or left-handed person.

IN THE DRAWING

DESCRIPTION OF THE PREFERRED EMBODIMENT OF THE INVENTION

Figure 1:
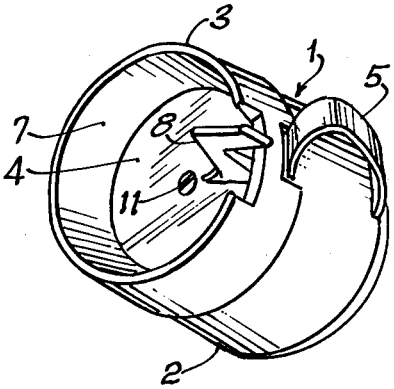
FIG. 1 is a perspective view of the cup shown in a tilted position.
Figure 2:
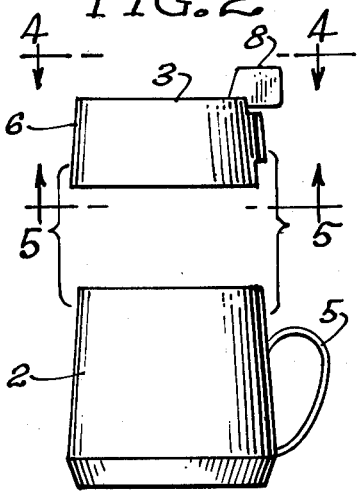
FIG. 2 is a front elevational view of the cup and its detached lid.
Figure 3:
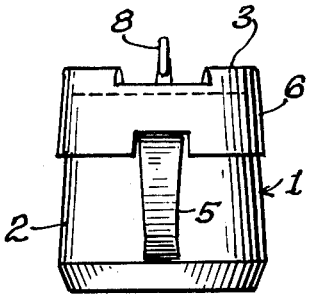
FIG. 3 is a right-side elevational view of the cup.
Figure 4:
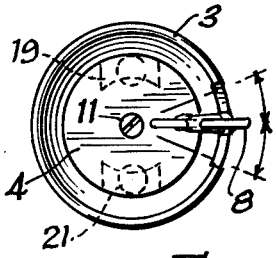
FIG. 4 is a top plan view of the lid showing a first alternate version of the shutter lever.

Referring now to the drawing and more particularly to FIGS. 1 through 9, there is illustrated a covered vessel 1, which can be used as a drinking cup, or as a holding or dispensing container for liquid or powdered substances such as creams, syrup or spices.

The vessel 1 comprises a mug-type or cup shaped receptacle 2, which is preferably made of two-layered plastic material for better thermal insulation. A detachable lid 3 has a wide overlapping rim 6 frictionally attached to the brim of the receptacle 2. The top of the lid 3 is caved in, thus forming a depressed area 7 having a flat circular base 10.

The lid 3 has two small, round orifices 9 diametrically opposed on the periphery of the base 10.

A shutter for closing the orifices 9 comprises a pair of valves 16 mounted under said orifices 9. Each valve 16 is resiliently held against the orifice 9 by a strip of plastic material 14 which is attached at its mid-section to the hub 13 of the circular base 10. The strip 14 thus forms two resilient arms, each supporting a valve 16. Two alternate versions of the valves 16 are illustrated.

Figure 5:
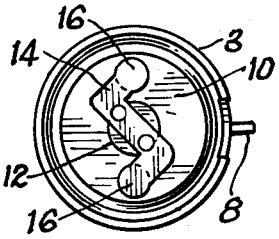
FIG. 5 is a bottom view of the lid showing a first alternate version of the shutter valve.
Figure 11:
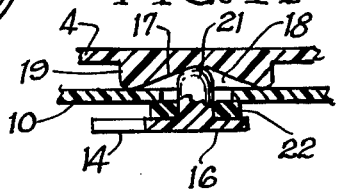
FIG. 11 is a cross-sectional view of the first alternate version of the shutter valve shown in the closed position.
Figure 12:
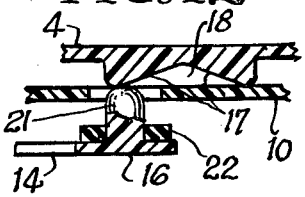
FIG. 12 is a cross-sectional view thereof shown in the open position.

In the first alternate version shown in FIGS. 5, 11 and 12 or small shaft 21 extended from the resilient arm 14 through the orifice 9. A plastic or rubber grommet or washer 22 at the base of shaft 21 close orifice 9.

Figure 7:
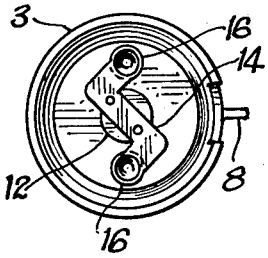
FIG. 7 is a bottom view of the lid showing a second alternate version of the shutter valve.
Figure 8:
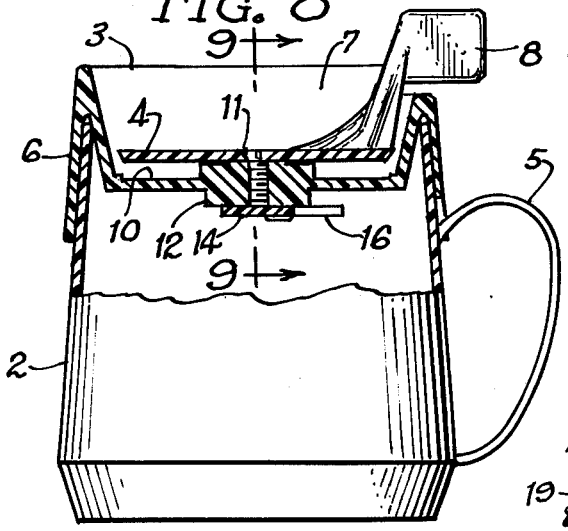
FIG. 8 is an enlarged elevational view of the cup with a cut-away portion illustrating the median cross-section of the lid shutter mechanism.
Figure 9:
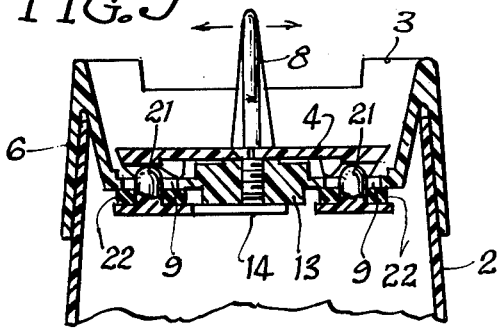
FIG. 9 is a partial cross-sectional view of the cup taken along line 9—9 of FIG. 8.
Figure 10:
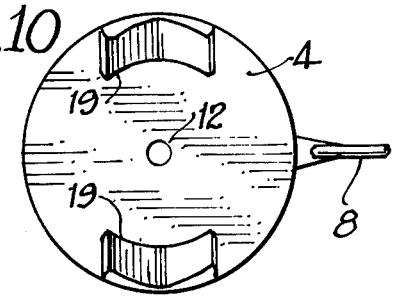
FIG. 10 is a bottom view of the first alternate version of the shutter lever shown in FIG. 4.
Figure 13:
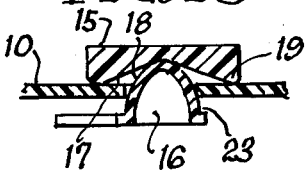
FIG. 13 is a cross-sectional view of the second alternate version of the shutter valve shown in the closed position; and, FIG. 14 is a cross-sectional view thereof shown in the close position.
Figure 14:
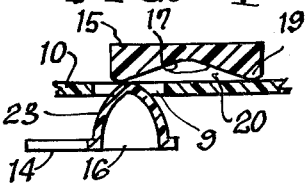

In a second alternate version of the valve 16 illustrated in FIGS. 7, 13 and 14, a nipple-shaped extension 23 is engaged into the orifice closing it.

The tip of the shaft and the tip 18 of the nipple-shaped extension 23 protrude through the orifice 9 above the level of the circular base 10 when the orifices are closed.

The valves 16 are actuated by pushing downward on the protruding tips 18 by means of a thumb actuated cam and lever system.

Two alternate versions of the cam and lever system are disclosed.

A first alternate version is illustrated in FIGS. 1, 4, 8, 9 and 10. A flat disk 4 is mounted above and coaxially with the circular base 10. It is secured to the raised hub 13 of the base by a screw 11 engaging a hole 12 in the center of the disk 4. Under the disk 4 two cams 19 extend downward from locations immediately above the orifice 9. Each cam 19 has a depression 20 with symetrical slanted edges 17 caping the protruding tip 18 of the valve.

A finger action pusher 8 associated with the disk extends beyond the peripheral edge or rim of the lid 2.

Rotation of the disk 4 in either direction causes the cam 19 to actuate the valve 16, thus opening the orifice 9.

Figure 6:
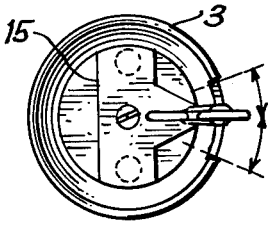
FIG. 6 is a top plan view of the lid showing a second alternate version of the shutter lever.

A second alternate version of the cam and lever system is illustrated in FIGS. 6, 13 and 14. In this particular embodiment, sections of the disk 4 of the first version have been cut to expose parts of the circular base 10.

It will be apparent to those skilled in the mechanical arts that other variations may be made in the details of construction, as of application without departing from the spirit of the invention and the scope of the appended claims.

I claim:

1. A vessel for drinking or for holding and pouring powdered and liquid substances which comprises:

a cup-shaped receptacle;

a detachable lid covering the receptacle having a depressed top area and at least one orifice within the depressed top area;

a shutter matching said orifice;

means for resiliently holding the shutter against said orifice; and, means rotating within a plane perpendicular to the central axis of said receptacle and lid for pushing the shutter away from said orifice in a direction substantially orthogonal to the plane of said orifice.

2. A vessel for drinking or for holding and pouring powdered and liquid substances which comprises:

a cup-shaped receptacle;

a detachable lid covering the receptacle having a depressed top area and at least one orifice within the depressed top area;

a shutter matching said orifice;

means for resiliently holding the shutter against said orifice; and rotating means for pushing the shutter away from said orifice in a direction substantially orthogonal to the plane of said orifice wherein the shutter and resilient means are mounted under said orifice; the shutter normally protrudes through said orifice and said means for pushing is mounted above said orifice.

3. The vessel claimed in 2 wherein said rotating means comprises:

a disk concentrically mounted in the bottom of said depressed area;

means for rotatingly attaching said disk to said lid;

a cam associated with the disk acting upon said protruding shutter; and, a thumb pusher projecting upward from said disk and beyond the peripheral edge of the lid.

4. The vessel claimed in 3 wherein said lid has two orifices diametrically located near opposite edges of said depressed area;

said means for resiliently holding comprises a strip of flexible plastic fastened at its mid-length to the bottom center of said lid;

said shutter comprises two shafts extending from said strip each through one of said orifices;

a grommet mounted over each of said shafts closing said orifices; and, said disk comprises two diametrically opposed cams each acting upon each of the shafts.

5. The vessel claimed in 4 wherein each said cam comprises:

rotating disk having a depression underneath engaging one of the shafts said depression having symmetrically slanted edges whereby said shaft is pushed downward by said edges upon rotation of the disk in either direction.

* * * * *